US005995057A

United States Patent [19]

Faith et al.

[11] Patent Number: 5,995,057

[45] Date of Patent: Nov. 30, 1999

[54] DUAL MODE HORN REFLECTOR ANTENNA

[75] Inventors: James T. Faith; Chun-Hong H. Chen, both of Torrance, Calif.

[73] Assignee: TRW Inc., Redondo Beach, Calif.

[21] Appl. No.: 09/085,617

[22] Filed: May 27, 1998

[51] Int. Cl.[6] ..... H01Q 13/00; H01P 1/16

[52] U.S. Cl. ..... 343/781 R; 343/786; 333/21 R; 333/21 A

[58] Field of Search ..... 343/781 R, 783, 343/786, 795; 333/21 R, 21 A, 125, 137

[56] References Cited

U.S. PATENT DOCUMENTS

| | | | |
|---|---|---|---|
| 3,646,565 | 2/1972 | Robinson et al. | 343/781 |
| 3,750,182 | 7/1973 | Kernwels | 343/783 |
| 4,112,432 | 9/1978 | Wong et al. | 343/786 |
| 4,313,119 | 1/1982 | Garay et al. | 343/702 |
| 4,635,070 | 1/1987 | Hoover | 343/852 |
| 4,652,885 | 3/1987 | Saffold et al. | 343/725 |
| 4,700,195 | 10/1987 | Boan et al. | 343/786 |
| 4,774,520 | 9/1988 | Bouko et al. | 343/783 |
| 4,792,814 | 12/1988 | Ebisui | 343/786 |
| 5,532,708 | 7/1996 | Krenz et al. | 343/795 |
| 5,614,916 | 3/1997 | Mizuguchi | 343/786 |

OTHER PUBLICATIONS

J.N. Hines, et al., "The Electrical Characteristics of the Conical Horn–Reflector Antenna," Bell Syst. Tech. J., vol. 42, pt. 2, Jul. 1963, pp. 422–446.

Joakim F. Johansson, et al., "The Diagonal Horn as a Sub–Millimeter Wave Antenna," IEEE Transactions on Microwave Theory and Techniques, vol. 40, No. 5, May 1992, pp. 795–800.

A. W. Love, "The Diagonal Horn Antenna," The Microwave Journal, vol. V, Mar. 1962, pp. 189–194.

Yassin, et al., "The Electrical Characteristics of a Conical Horn–Reflector Antenna Employing a Corrugated Horn," IEEE Transactions on Antennas and Propogation, vol. 41, No. 3, Mar. 1993, pp. 357–361.

*Primary Examiner*—Don Wong
*Assistant Examiner*—Jennifer H. Malos
*Attorney, Agent, or Firm*—Michael S. Yatsko; Connie M. Thousand

[57] ABSTRACT

A dual mode horn reflector antenna for providing an antenna pattern having symmetrical beamwidths over a bandwidth of approximately 40%. An input $TE_{10}$ rectangular mode signal is provided to the dual mode horn reflector antenna which generates a first $TE_{11}$ circular mode signal from the input $TE_{10}$ rectangular mode signal. A first $TE_{10}$ square mode signal and a first $TE_{01}$ square mode signal are generated from the first $TE_{11}$ circular mode signal. The first $TE_{10}$ square mode signal and the first $TE_{01}$ square mode signal are combined generate a resultant signal. The resultant signal is incident upon a reflecting structure which generates an antenna pattern having approximately equivalent beamwidths in perpendicular planes, and reduced sidelobes.

20 Claims, 4 Drawing Sheets

DUAL MODE HORN REFLECTOR ANTENNA

BACKGROUND OF THE INVENTION

The present invention relates generally to antenna, and more particularly to a dual mode horn reflector antenna having equalized principle plane beamwidths and reduced sidelobes over a large bandwidth of performance.

Spacecraft communication systems often require medium gain antennas which provide adequate area gains, large bandwidth, equalized principal plane beamwidths and low sidelobes while maintaining a compact physical size. A reflector antenna is typically not a good choice for medium gain applications since the reflector antenna approaches diffraction limitations when used in medium gain applications. A horn antenna is also not a good choice for medium gain applications since the horn becomes excessively large when used in medium to high gain applications. A horn reflector antenna can be a good choice for medium to high gain applications since it is compact in size and can provide approximately medium gain.

A typical horn reflector antenna is comprised of a conical electromagnetic horn and a reflector which is a sector of a paraboloid of revolution, the apex of the horn coincides with the focus of the paraboloid of revolution and the axis of the horn is perpendicular to the axis of the paraboloid. Because of the design, very little energy incident on the reflector is returned into the feed so that mismatch problems are avoided. Also, because of the shielding effect of the horn, side and back lobes are minimized. Therefore, this type of antenna can be quite useful for microwave communications. A more detailed discussion of the conical horn-reflector antenna can be found in "The Electrical Characteristics of the Conical Horn-Reflector Antenna", by J. N. Hines, et. al, published in the Bell System Technical Journal, volume 42, pages 1187–1211, 1963. However, disadvantages in the conical horn-reflector antenna such as unequal principle plane beamwidths and high close in sidelobe levels have prevented the conical horn-reflector antenna from widespread use.

Attempts have been made to equalize the two principle plane beamwidths and reduce the close in sidelobes by using a corrugated horn instead of the typical conical horn. While successful, the machining required to fabricate the corrugated horn section is quite extensive and expensive typically requiring a five axis CNC machine and electroforming the corrugated horn on a mandrel. A more detailed discussion of the corrugated horn-reflector antenna can be found in "The Electrical Characteristics of a Conical Horn-Reflector Antenna Employing a Corrugated Horn", by Ghassan Yassin, et. al., IEEE Transactions on Antennas and Propagation, Vol. 41, No. 3, March 1993.

To avoid the effort and expense involved in manufacturing a corrugate feed while retaining beam symmetry, a Potter horn has been used in a horn-reflector configuration. The Potter horn, detailed in the article "A new horn antenna with suppressed sidelobes and equal beamwidths," by Potter, P. D., Microwave Journal, 4, pg. 71–78, 1963, has a transition section attached to a phasing section feeding a conical horn. An input $TE_{11}$ circular mode signal is fed into the transition section and is incident on the phasing section. The phasing section is an axially symmetric step which generates both a $TE_{11}$ circular mode signal and a $TM_{11}$ circular mode signal form the input $TE_{11}$ circular mode signal. The non-symmetric higher order modes are suppressed by the proper choice of the diameter of the phasing section and the asymmetric modes are not strongly excited due to step symmetry. Therefore, only the $TE_{11}$ and $TM_{11}$ modes propagate after the step. The $TE_{11}$ and $TM_{11}$ mode signal must be combined in the phasing section in the proper amplitude and phase to produce an antenna pattern having equal principle plane beamwidths. The difference in the diameters before and after the step determines the relative mode amplitude, and length of the phasing section determines the phase. The length of the phasing section is chosen to provide proper combining of the $TE_{11}$ and $TM_{11}$ mode signals at a design frequency.

As the frequency deviates from the design frequency, the phase relationship between the $TE_{11}$ and $TM_{11}$ modes changes and proper combining of the two modes no longer occurs generating a non-symmetrical beam pattern. Calculations and measurements have shown that when using the fundamental $TE_{11}$ and $TM_{11}$ mode signals, a symmetrical pattern results over a relatively narrow bandwidth of approximately 5%.

A need exists to provide a compact antenna that provides medium gain with symmetrical beams over a large bandwidth of operation.

SUMMARY

The preceding and other shortcomings of the prior art are addressed and overcome by the present invention which provides a dual mode horn reflector antenna having an input $TE_{10}$ rectangular mode signal. The dual mode horn reflector antenna includes a first transition section, a second transition section, a square horn and a reflective structure. The first transition section generates a first $TE_{11}$ circular mode signal from the input $TE_{10}$ rectangular mode signal. The second transition section is coupled to the first transition section such that the first $TE_{11}$ circular mode signal is supplied to the second transition section. The second transition section generates a first $TE_{10}$ square mode signal and a first $TE_{01}$ square mode signal from the first $TE_{11}$ circular mode signal. The first $TE_{10}$ square mode signal is combined with first $TE_{01}$ square mode signal to generate a resultant signal. Since the $TE_{10}$ and $TE_{01}$ modes have the same phase velocity, the phase difference between modes does not change with frequency allowing a larger bandwidth of operation.

A horn is coupled to the second transition section such that the resultant signal propagates in and radiates from the horn. A reflecting structure is located within the near field of the horn and the resultant signal is incident upon the reflecting structure. The reflecting structure generates an antenna pattern having approximately equivalent beamwidths in perpendicular planes.

For one embodiment of the invention, the equivalent beamwidths occur over an approximately 40% bandwidth.

The foregoing and additional features and advantages of this invention will become apparent from the detailed description and accompanying drawings figures below. In the figures and the written description, numerals indicated the various features of the invention, like numerals referring to like features throughout for both the drawing figures and the written description.

DETAILED DESCRIPTION OF THE INVENTION

Figure 1:
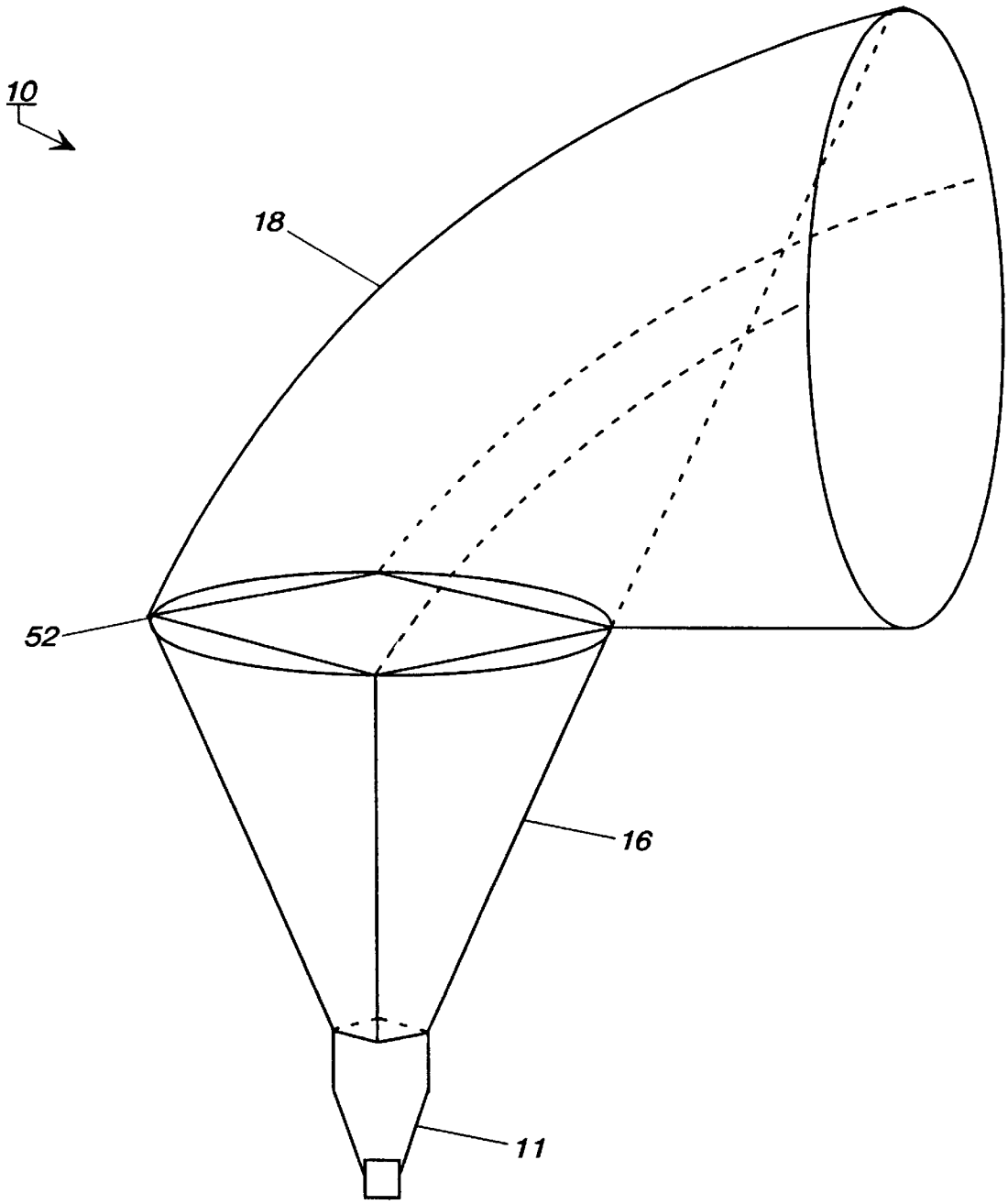
FIG. 1 is a diagram of a dual mode horn reflector antenna in accordance with a preferred embodiment of the present invention.

Referring to FIG. 1, a dual mode horn-reflector antenna 10 for providing symmetrical beamwidths and reduced sidelobes over a large bandwidth is illustrated. The dual mode horn reflector antenna 10 generates degenerative $TE_{10}$ and $TE_{01}$ square mode signals having the proper amplitude and phase and combines them together into a resultant signal. This resultant signal is incident on the reflecting structure 18 creating an antenna pattern. The phase relationship of the degenerative $TE_{10}$ and $TE_{01}$ square mode signals does not vary with frequency such that proper combining of the signals can be accomplished over a large bandwidth, typically over 40%, providing a symmetrical beam antenna pattern over an approximate 40% bandwidth.

The dual mode horn reflector antenna 10 of the present invention is preferably utilized to provide a medium gain, symmetrical beam antenna pattern from a spacecraft. However, the present invention is not limited to spacecrafts, but may also be utilized in communications networks as well as ground stations.

Figure 2:
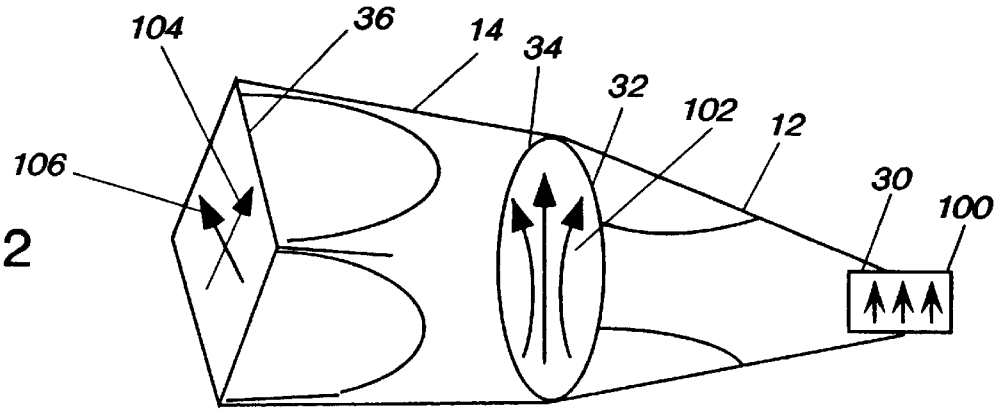
FIG. 2 is a diagram showing a portion of the dual mode horn reflector antenna in accordance with the preferred embodiment of the present invention.
Figure 3:
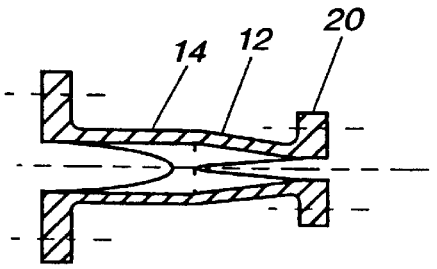
FIG. 3 is a diagram showing the first and second transition sections of the dual mode horn reflector antenna in accordance with the preferred embodiment of the present invention.

The dual mode horn reflector antenna 10 includes a mode transition section 11, a horn 16 and a reflective structure 18. As shown in FIG. 2, for the preferred embodiment of the invention, a first 12 and a second 14 transition section comprise the mode transition section 11 (FIG. 1). Referring now to FIG. 2, an input $TE_{10}$ rectangular mode signal 100 is input into the first transition section 12. The first transition section 12 generates a first $TE_{11}$ circular mode signal 102 from the input $TE_{10}$ rectangular mode signal 100. For the preferred embodiment of the invention, the first transition section 12 has a first rectangular opening 30 and a first circular opening 32. Referring to FIG. 3, for the preferred embodiment of the invention, a first waveguide flange 20 is coupled to the first rectangular opening 30 to facilitate inputting the input $TE_{10}$ rectangular mode signal 100 (FIG. 2) into the first transition section 12.

The first rectangular opening 30 has a rectangular cross section. The rectangular cross section gradually transitions into a circular cross section over the length of the first transition section 12 terminating into the first circular opening 32 having a circular cross section. The gradual transition from a rectangular cross section into a circular cross section generates a $TE_{11}$ circular mode signal 102 from the input $TE_{10}$ rectangular mode signal 100 without generating additional undesirable higher-order modes. The $TE_{11}$ circular mode signal 102 is output from the first transition section 12 at the first circular opening 32.

A second transition section 14 is coupled to the first transition section 12. The $TE_{11}$ circular mode signal 102 is supplied to the second transition section 14 from the first transition section 12. The second transition section 14 generates both a $TE_{01}$ square mode signal 104 and a $TE_{10}$ square mode signal 106 from the first $TE_{11}$ circular mode signal 102.

For the preferred embodiment of the invention, the second transition section 14 has a second circular opening 34 and a first square opening 36. The $TE_{11}$ circular mode signal 102 is supplied to the second transition section 14 through the second circular opening 34 of the second transition section 16. The second circular opening 34 has a circular cross section which gradually transitions into a square cross section over the length of the second transition section 14 terminating into a first square opening 36 having a square cross section. The gradual transition from a circular cross section into a square cross section generates both a $TE_{01}$ square mode signal 104 and a $TE_{10}$ square mode 106 signal from the $TE_{11}$ circular mode signal 102.

Figure 4:
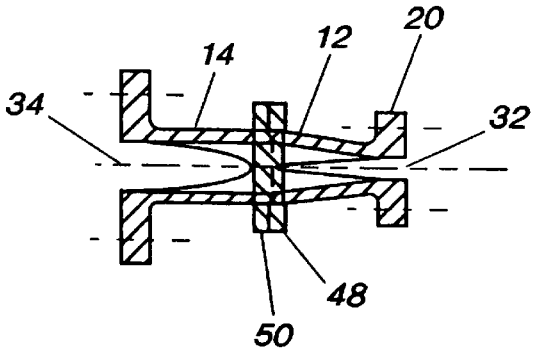
FIG. 4 is a diagram showing the first and second transition sections of the dual mode horn reflector antenna in accordance with an alternate embodiment of the present invention.

Referring now to FIG. 3, for the preferred embodiment of the invention, the first 12 and second 14 transition sections are formed as a single intragal unit. For an alternative embodiment of the invention, the first 12 and second 14 transition sections are formed as separate units. For this embodiment, shown in FIG. 4, second 48 and third 50 waveguide flanges are coupled to the first circular opening 32 and the second circular opening 34 of the first 12 and second 14 transition sections respectively. The second 48 and third 50 waveguide flanges are equivalent such that they can be coupled together facilitating the coupling of the first 12 and second 14 transition sections. The first 32 and second 34 circular opening are of the same size such that a smooth transition exists from the first transition section 12 into the second transition section 14. A smooth transition between the first 12 and the second 14 transition section allows the $TE_{11}$ circular mode signal 102 (FIG. 2) to be supplied to the second transition section 14 from the first transition section 12 free of any discontinuities or steps which could generate undesirable modes.

Figure 5:
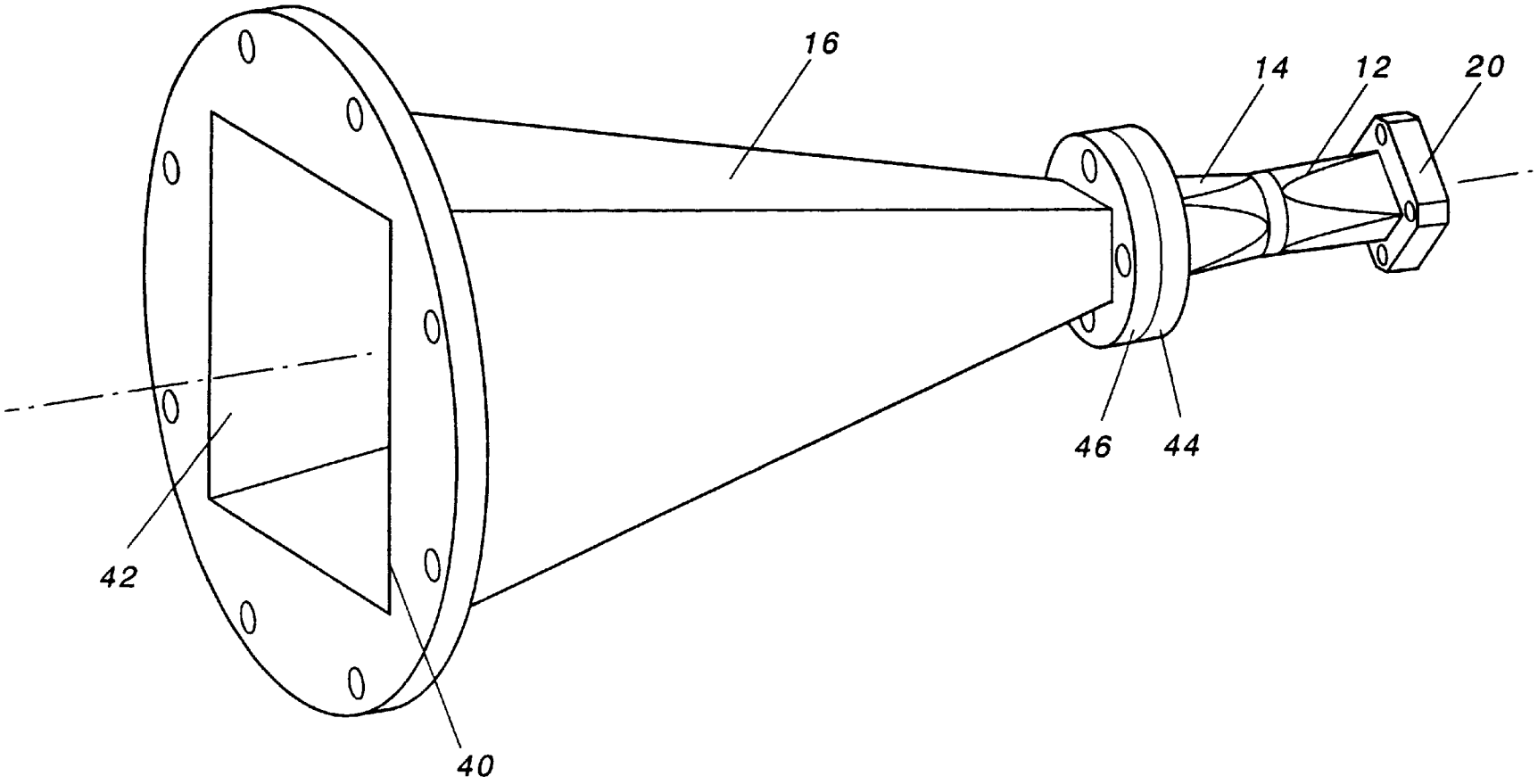
FIG. 5 is an isometric drawing of a portion of the dual mode horn reflector antenna in accordance with the preferred embodiment of the invention.

Referring to FIG. 5, a horn 16 is coupled to the second transition section 14. The $TE_{01}$ 104 and $TE_{10}$ 106 square mode signals (FIG. 2) are supplied to the horn 16 (FIG. 5) from the second transition section 14. The horn 16 combines the $TE_{01}$ 104 and $TE_{10}$ 106 (FIG. 2) square mode signals to generate a resultant signal which propagates in the horn 16 (FIG. 5) and radiates from the horn 16. The second square opening 38 has a square cross section which gradually increases in size over the length of the horn 16 terminating into the third square opening 40. The gradual taper allows the resultant signal to propagate in the horn 16 without generating additional undesirable signals. The resultant signal propagates from the horn 16 through the third square opening 40.

Figure 6:
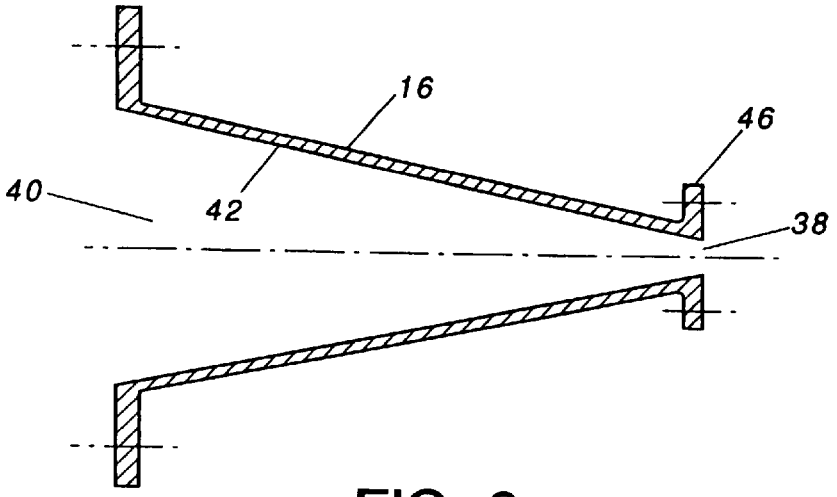
FIG. 6 is a diagram showing the horn of the dual mode horn reflector antenna in accordance with the preferred embodiment of the invention; and, FIG. 7 is a side view showing the dual mode horn reflector antenna in accordance with the preferred embodiment of the invention.

Referring to FIG. 6, for the preferred embodiment of the invention, the horn 16 has a second 38 and a third 40 square opening and an interior surface 42 that is free of corrugations. The second square opening 38 of the horn 16 is equivalent in size to the first square opening 36 (FIG. 2) of the second transition section 14 such that a smooth transition exists between the second transition section 14 and the horn 16 (FIG. 5). A smooth transition between the second transition section 14 and the horn 16 allows the $TE_{01}$ 104 and $TE_{10}$ 106 square mode signals (FIG. 2) to be supplied to the horn 16 (FIG. 5) from the second transition section 14 free of any discontinuities or steps which could generate undesirable modes. For the preferred embodiment of the invention, the second transition section 14 further includes a fourth waveguide flange 44 coupled to the first square opening 36 (FIG. 2); and, the horn 16 (FIG. 5) further includes a fifth waveguide flange 46 coupled to the second square opening 38 (FIG. 6) of the horn 16. The fourth 44 and fifth 46 flanges are equivalent such that they can be coupled together, as shown in FIG. 5, resulting in the second transition section 14 and the horn 16 being coupled together.

Figure 7:
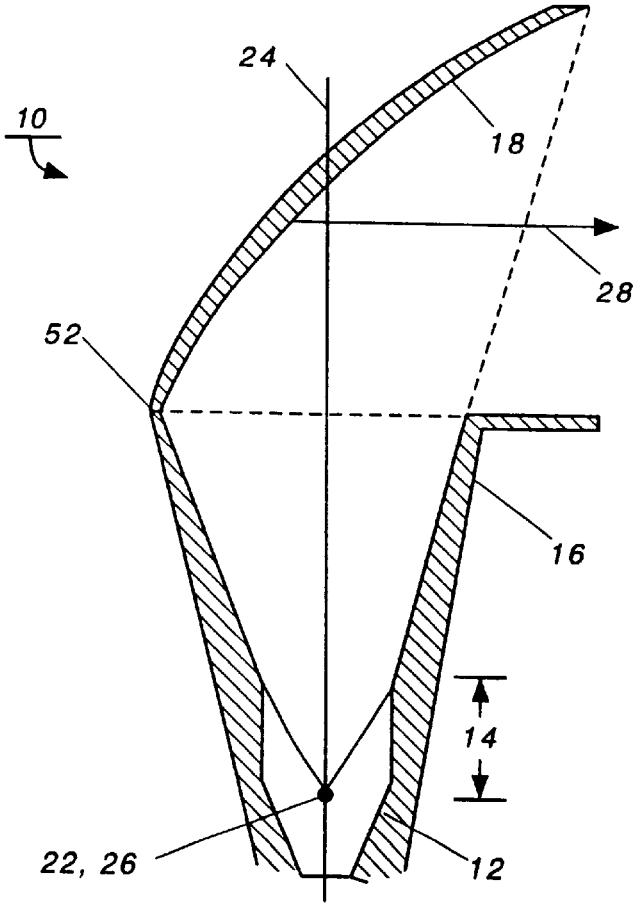

Referring back to FIG. 1, a reflecting structure 18 is placed in the near field of the horn 16. The resultant signal propagates from the horn 16 and is incident on the reflecting structure 18. The reflecting structure 18 directs the resultant signal away from the horn 16 generating an antenna pattern. As shown in FIG. 7, for the preferred embodiment of the invention, the horn 16 is connected to the reflective structure 18 at point 52 and the reflective structure 18 is a sector of a paraboloid of revolution having an axis of radiation 28 . The horn 16 has a virtual apex 22 and a central axis 24. The virtual apex 22 is coincident with the focal point 26 of the paraboloid of revolution 18. The axis of the horn 24 is perpendicular to the axis of radiation 28. The resultant signal propagates from the horn 16 in the direction of the axis of the horn 24 and is incident on the paraboloid of revolution 18. The paraboloid 18 reflects the resultant signal in a direction parallel to the axis of radiation 28 thereby creating an antenna pattern in a direction defined by the axis of radiation 28. Calculations have shown that the antenna pattern generated from the dual mode horn reflector antenna has approximately equivalent beamwidths in orthogonal planes and the equivalent beamwidths occur over at least a 40% bandwidth.

The present invention is not limited to the specific embodiments described above. In particular, the present invention is not limited to a horn-reflector antenna having two transition sections to generate $TE_{10}$ and $TE_{01}$ mode signals having equal amplitudes and phases. Alternative methods of generating $TE_{10}$ and a $TE_{01}$ mode signals having equal amplitudes and phases, For example, the direct transition described in "The Diagonal Horn as a Sub-Millimeter Wave Antenna", Joakim Johansson et. al., IEEE Transactions on Microwave Theory and Techniques, Vol. 40, No. 5, May 1992, can be utilized to generate TE10 and TE01 mode signals having equal amplitudes and phases.

The present invention generates a $TE_{01}$ 104 and a $TE_{10}$ 106 mode signal having equal amplitudes and phases and combines these two signals into a resultant signal. The resultant signal is propagated in a horn having a square cross section the interior of which is free of corrugations. A reflective structure is located in the near field of the horn such that the resultant signal is incident on the reflecting structure creating an antenna pattern. By doing so, the present invention provides a compact antenna having medium gain and exhibiting symmetrical beamwidths in orthogonal planes over at least a 40% bandwidth with close-in sidelobe levels of better than approximately −22 dB which is approximately 6 dB lower than the prior art conical horn-reflector antenna.

It will be appreciated by persons skilled in the art that the present invention is not limited to what has been shown and described hereinabove, nor the dimensions or sizes of the physical implementations described. The scope of the invention is limited solely by the claims which follow.

We claim as our invention:

1. A dual mode horn reflector antenna having an input $TE_{10}$ rectangular mode signal comprising:

a mode transition section, said input $TE_{10}$ rectangular mode signal supplied to said mode transition section, said mode transition section generating a first $TE_{10}$ square mode signal and a first $TE_{01}$ square mode signal from said input $TE_{10}$ rectangular mode signal, said first $TE_{01}$ square mode signal and said first $TE_{10}$ square mode signals having approximately equal amplitude and equal phases, said mode transition section combining said first $TE_{10}$ square mode signal and said first $TE_{01}$ square mode signals to generate a resultant signal;

a horn having a near field, said horn coupled to said mode transition section, said resultant signal supplied to said horn from said mode transition section, said resultant signal propagating in said horn and radiating from said horn; and, a reflecting structure being located within said near field of said horn, said resultant signal incident upon said reflecting structure, said reflecting structure generating an antenna pattern from said resultant signal.

2. A dual mode horn reflector antenna as in claim 1, wherein said reflecting structure is connected to said horn.

3. A dual mode horn reflector antenna as in claim 1, wherein said antenna pattern has approximately equivalent beamwidths in orthogonal planes.

4. A dual mode horn reflector antenna as in claim 3, wherein said equivalent beamwidths occur over a frequency band of approximately 40%.

5. A dual mode horn-reflector antenna as in claim 1, wherein said antenna pattern has a sidelobe level less than or equal to approximately −22 dB.

6. A dual mode horn-reflector antenna as in claim 1, wherein said antenna pattern has a reduced sidelobe level when compared to a conical horn-reflector antenna.

7. A dual mode horn-ref lector antenna as in claim 6, wherein said reduced sidelobe level is at least approximately 6 dB.

8. A dual mode horn reflector antenna as in claim 7, wherein said reflective structure is a sector of a paraboloid of revolution having a focal point and an axis of radiation, said horn having a central axis and a virtual apex coincident with said focal point, said axis of radiation approximately perpendicular to said central axis.

9. A dual mode horn reflector antenna as in claim 1, wherein said horn further comprises an interior surface free of corrugations.

10. A dual mode horn reflector antenna as in claim 1, wherein said horn further comprises a square cross section.

11. A dual mode horn-reflector antenna as in claim 1, wherein said mode transition section further comprises a first transition section and a second transition section, said input $TE_{10}$ rectangular mode signal supplied to said first transition section, said first transition section generating a first $TE_{11}$ circular mode signal from said input $TE_{10}$ rectangular mode signal, said second transition section coupled to said first transition section, said first $TE_{11}$ circular mode signal supplied to said second transition section from said first transition section, said second transition section generating a first $TE_{10}$ square mode signal and a first $TE_{01}$ square mode signal from said first $TE_{11}$ circular mode signal, said first $TE_{01}$ square mode signal and said first $TE_{11}$ circular mode signals having approximately equal amplitude and equal phases, said second transition section combining said first $TE_{10}$ square mode signal and said first $TE_{01}$ square mode signals to generate said resultant signal, said horn coupled to said second transition section, said resultant signal supplied to said horn from said second transition section.

12. A dual mode horn reflector antenna having an input $TE_{10}$ rectangular mode signal comprising:

a first transition section having a first rectangular opening and a first circular opening, said input $TE_{10}$ rectangular mode signal supplied to said first transition section through said first rectangular opening, said first transition section gradually transitioning from said first rectangular opening into said first circular opening generating a first $TE_{11}$ circular mode signal from said input $TE_{10}$ rectangular mode signal, said first $TE_{11}$ circular mode signal supplied at said first circular opening;

a second transition having a second circular opening and a first square opening, said second circular opening coupled to said first circular opening, said first $TE_{11}$ circular mode signal supplied to said second transition section through said second circular opening, said second transition section gradually transitioning from said second circular opening into said first square opening generating a first $TE_{10}$ square mode signal and a first $TE_{01}$ square mode signal from said first $TE_{11}$ circular mode signal, said first $TE_{10}$ square mode signal and said first $TE_{11}$ circular mode signals having approximately equal amplitude and equal phases, said second transition section combining said first $TE_{10}$ square mode signal and said first $TE_{10}$ square mode signals to generate a resultant signal, said resultant signal supplied at said first square opening;

a horn having a near field, an interior free of corrugations, and a second and a third square opening, said second square opening coupled to said first square opening and smaller than said third square opening, said resultant signal supplied to said horn through said second square opening, said resultant signal propagating in said horn and radiating from said horn through said third square opening; and, a reflecting structure being located within said near field of said horn, said third square opening of said horn being closer to said reflecting structure than said second square opening of said horn, said resultant signal incident upon said reflecting structure, said reflecting structure generating an antenna pattern from said resultant signal.

13. A dual mode horn reflector antenna as in claim 12, wherein said reflecting structure is connected to said horn.

14. A dual mode horn reflector antenna as in claim 12, wherein said antenna pattern has approximately equivalent beamwidths in orthogonal planes.

15. A dual mode horn reflector antenna as in claim 12, wherein said equivalent beamwidths occur over a frequency band of approximately 40%.

16. A dual mode horn-reflector antenna as in claim 12, wherein said antenna pattern has a sidelobe level less than or equal to approximately −22 dB.

17. A dual mode horn-reflector antenna as in claim 12, wherein said antenna pattern has a reduced sidelobe level when compared to a conical horn-reflector antenna.

18. A dual mode horn-reflector antenna as in claim 17, wherein said reduced sidelobe level is at least approximately 6 dB.

19. A dual mode horn reflector antenna as in claim 12, wherein said first and second transition sections are formed as a single intragal unit.

20. A dual mode horn reflector antenna as in claim 12, wherein said reflective structure is a sector of a paraboloid of revolution having a focal point and an axis of radiation, said horn having a central axis and a virtual apex coincident with said focal point, said axis of radiation approximately perpendicular to said central axis, said horn connected to said reflective structure.

* * * * *